US009484669B2

(12) United States Patent
Hiscoke

(10) Patent No.: US 9,484,669 B2
(45) Date of Patent: Nov. 1, 2016

(54) LOCKING ELECTRICAL CONNECTOR

(71) Applicant: SCOLMORE INTERNATIONAL LIMITED, Tamworth, Staffordshire (GB)

(72) Inventor: Daniel Hiscoke, Staffordshire (GB)

(73) Assignee: SCOLMORE (INTERNATIONAL) LIMITED, Tamworth, Staffordshire (GB)

( * ) Notice: Subject to any disclaimer, the term of this patent is extended or adjusted under 35 U.S.C. 154(b) by 0 days.

(21) Appl. No.: 14/401,951

(22) PCT Filed: May 3, 2013

(86) PCT No.: PCT/GB2013/000195
§ 371 (c)(1),
(2) Date: Nov. 18, 2014

(87) PCT Pub. No.: WO2013/171440
PCT Pub. Date: Nov. 21, 2013

(65) Prior Publication Data

US 2015/0180172 A1 Jun. 25, 2015

(30) Foreign Application Priority Data

May 18, 2012 (GB) ..... 1208834.0

(51) Int. Cl.
*H01R 13/627* (2006.01)
*H01R 13/635* (2006.01)
(Continued)

(52) U.S. Cl.
CPC ..... *H01R 13/635* (2013.01); *H01R 13/58* (2013.01); *H01R 13/6272* (2013.01); *H01R 13/6275* (2013.01); *H01R 13/6335* (2013.01); *H01R 24/22* (2013.01); *H01R 2103/00* (2013.01)

(58) Field of Classification Search
USPC ..... 439/352
See application file for complete search history.

(56) References Cited

U.S. PATENT DOCUMENTS 5,564,939 A 10/1996 Maitani et al.
7,114,980 B1 10/2006 Wu
(Continued)

FOREIGN PATENT DOCUMENTS

DE 20 2011 108080 U1 3/2012
GB 2 383 202 A 6/2003
(Continued)

OTHER PUBLICATIONS

International Search Report, dated Sep. 4, 2013, from corresponding PCT application.
(Continued)

*Primary Examiner* — Tho D Ta
(74) *Attorney, Agent, or Firm* — Young & Thompson

(57) ABSTRACT

An electrical connector (10) of elongate shape includes a main body (11) having a first end region (18) which includes one or more electrical contacts in use for contact with a complementary connector component and a second end region (24) opposite the first end region and from which depends a protective guide (12) through which a flexible conductor may extend, the main body of the connector including a locking mechanism (20) whereby, in use, the connector (10) may be selectively releasably secured to a complementary connector component, and the connector (10) including a release control (14) operable to act on the locking mechanism and allow release of the connector from the complementary connector component, wherein the release control (14) is operable at a position further from the first end (18) of the connector than the second end (24) as considered in the direction of the length of the connector.

20 Claims, 3 Drawing Sheets

(51) Int. Cl.

| | |
|---|---|
| ***H01R 13/633*** | (2006.01) |
| ***H01R 13/58*** | (2006.01) |
| *H01R 103/00* | (2006.01) |
| *H01R 24/22* | (2011.01) |

(56) References Cited

U.S. PATENT DOCUMENTS

| | | | | |
|---|---|---|---|---|
| 7,318,740 | B1 | 1/2008 | Henry et al. | |
| 7,473,124 | B1 | 1/2009 | Briant et al. | |
| 7,771,225 | B1 * | 8/2010 | Wu | H01R 9/032 439/352 |
| 8,035,975 | B2 * | 10/2011 | Wu | H01R 13/6335 361/727 |
| 2010/0087084 | A1 | 4/2010 | George | |
| 2011/0250791 | A1 | 10/2011 | Straka et al. | |
| 2012/0021627 | A1 | 1/2012 | Wang et al. | |
| 2012/0052714 | A1 | 3/2012 | Zerebilov et al. | |
| 2013/0183846 | A1 | 7/2013 | Kappla et al. | |

FOREIGN PATENT DOCUMENTS

| | | | |
|---|---|---|---|
| WO | 2009/065051 | A1 | 5/2009 |
| WO | 2011/089003 | A1 | 7/2011 |
| WO | 2012/015867 | A1 | 2/2012 |

OTHER PUBLICATIONS

GB Search Report, dated Oct. 30, 2012, from corresponding GB application.

UK Examination Report, dated Nov. 2, 2015, from corresponding UK application.

* cited by examiner

LOCKING ELECTRICAL CONNECTOR

BACKGROUND OF THE INVENTION

1. Field of the Invention

This invention relates to a locking electrical connector such as a connector used to connect between items of electrical equipment or to connect electrical equipment to a power supply.

2. Description of the Related Art

Some prior art connectors have been designed to reduce the ease with which the connector, whether in the form of a plug or socket, may be removed from or inadvertently may fall out from a mating socket or plug. A known solution, used commonly in computer equipment, is for screws or clips to be provided at either side of the connector to retain the connector attached to the equipment. However screwing or clipping the connector to the equipment is laborious and in many cases is rendered difficult by space limitations.

To address this problem it is known for a connector to be provided with a locking mechanism which a user needs to operate in order to separate the connector from a mating connector component.

An example of a well-known and successful locking connector is that described in our UK patent GB 2383202.

However, particularly in respect of computers and similar such electrical equipment the continuing drive for compactness of construction has resulted in a substantial reduction in the space envelope that conventionally has surrounded a removable connector.

Thus, for example, recently introduced types of PCU feature in proximity to the connector position additional metallic tabs or handles for easy removal from a server back. Due to the compactness of equipment design the release tab provided on many types of lockable electrical connectors prevents insertion, and in other cases the limited space envelope in proximity to the connector prevents access to the release control at such time as it may be required to remove the connector.

Typically the reduction of space envelope around a connector, when in situ connected to a mating plug or socket of an electrical equipment, is confined to a region which extends away from the equipment by a distance no greater than the length of the connector. Accordingly it should be possible to overcome the problem arising from the reduced space envelope by providing connectors having a longer length body. Thus the release control may then be spaced further from the interface end of the connector, at a position clear of, for example, any metallic tabs or handles. However that solution suffers the disadvantage that it would substantially negate the space reduction advantage which the more compactly designed equipment seeks to achieve. That is because a greater space would be required between the equipment and the wall or other surface in front of which the equipment is positioned in order to accommodate the longer length connector.

SUMMARY OF THE INVENTION

The present invention seeks to provide an improved locking electrical connector which may be employed with more modern electrical equipment and without requiring a greater spacing between the equipment and the surrounding environment.

In accordance with one aspect of the present invention an electrical connector of elongate shape comprises a main body having a first end region which comprises one or more electrical contacts in use for contact with a complementary connector component and a second end region opposite said first end region and from which depends a protective guide through which a flexible conductor may extend, said main body of the connector comprising a locking mechanism whereby, in use, the connector may be selectively releasably secured to a complementary connector component, and the connector comprising a release control operable to act on the locking mechanism and allow release of the connector from the complementary connector component, wherein said release control is operable at a position further from the first end of the connector than said second end as considered in the direction of the length of the connector.

Preferably the release control is operable from a position aligned with said protective guide, again as considered in the length direction of the connector.

The locking mechanism may be of a kind which effects a locking action between the electrical contact of the connector and that of the complementary connector component, for example to effect a locking action between a conductive pin and a conductive socket. Thus it may be of the type described in more detail in our UK patent, GB 2383202. Alternatively, however, it may be of a kind which effects a locking action between the main body of the connector and a body or other part of the complementary connector component.

The locking member may be positioned within the main body of the connector and the release control may connect to the locking mechanism from a position at the surface of the main body, preferably at a position close to said second end region of the main body.

The connector may comprise a handle which is an integral part of the release control, or which is securely connected thereto.

The handle preferably comprises one or more finger grip positions, such as recesses or apertures, which assist ease of application of force to actuate the release control to unlock the locking mechanism and facilitate withdrawal of the connector from a complementary connector component.

Preferably the release control is movable in the length direction of the connector, between a first, locking position and a second, release position. Preferably bias means is provided, for example as a part of the locking mechanism, whereby the release control normally resides in the first, locking position but on application of force applied to the handle in the lengthwise direction of the connector, in a direction from the first to the second end region of the connectors, effects movement of the release control to the second, release position.

The handle preferably has a cross-sectional shape which is no larger than the maximum cross-sectional shape of the main body, as considered in the length direction of the connector.

Preferably the release control does not protrude from the surface of the main body, as considered relative to said cross-sectional shape of the main body.

The handle may be of an open, tubular type shape which extends around the protective guide.

Preferably the handle is of a skeleton-like form having four side faces and wherein at least one and preferably all of the side faces are apertured or comprise a recess to provide a finger grip position. Thus operation of the handle from any access direction is assisted.

The protective guide for the cable or other form of conductor extending to the main body of the connector typically is semi-flexible as compared with the relatively rigid main body. Thus it serves to minimise the risk of the conductor being subject to potentially damaging sharp changes of direction at the exit region from the second end of the main body of the connector. The distal end of the handle preferably is spaced from the protective guide whereby in normal use it does not inhibit flexibility of the guide.

The handle may be supported in a position relative to the protective guide formation solely by being connected to or formed integrally with the release control or it may be supported additionally by means of one or more lugs or other formations which contact either the main body or protective guide of the connector.

One or more guide formations may be provided whereby, when force is applied to the handle to move it away from said first end region, the handle is guided to move in a direction substantially parallel with the length direction of the elongate electrical connector.

A guide formation may comprise a groove in one of the main body (or protective guide) and the handle. A groove engaging projection such as a lug may extend from the other of the main body (or protective guide) and the handle.

The connector may comprise a protective cable guide (or main body) having two opposite faces each formed with a groove and the handle may comprise two lugs each for engaging with a respective one of the grooves. The grooves preferably are orientated such that they will tend to guide the handle for movement in a direction substantially parallel with the length direction of the elongate connector.

Although some features of the present invention have been described in combination with other features of the present invention, it is to be understood that said features may be provided independently of one another or in combinations which differ from those specifically described.

BRIEF DESCRIPTION OF THE DRAWING FIGURES

One embodiment of the present invention will now be describe, by way of example only, with reference to the accompanying diagrammatic drawings in which:—

DETAILED DESCRIPTION OF THE INVENTION

Figure 1:
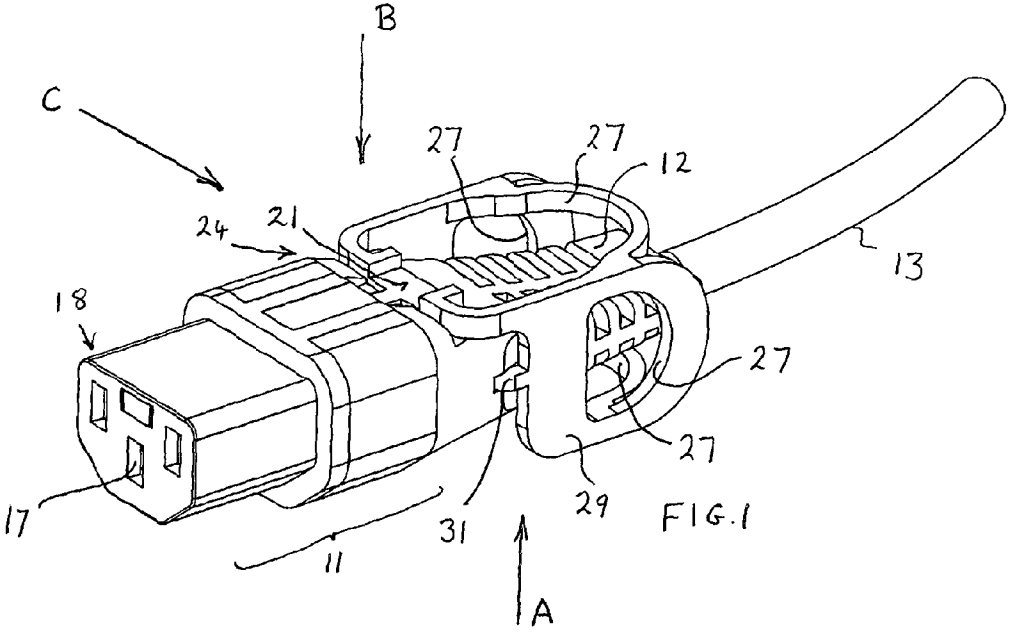
FIG. 1 is a perspective view of a connector in accordance with the present invention, in combination with an electrical cable.

A connector of the IEC type (known commonly as a "kettle plug") socket and of elongate shape comprises a main body 11, a cable guide 12 for a cable 13, a release control 14 and a handle 15.

The main body houses three sockets 16 to which respective conductors of the cable 13 are connected, the sockets being exposed via openings 17 in the first end region 18 of the main body.

The main body 11 incorporates also a locking mechanism 20 which, in the locking position and when in use of the connector to connect to a complementary connector component, engages with a pin inserted in one of the sockets so as to prevent withdrawal from the pin until the locking mechanism, under action of the release control 14, is moved to a release condition. A suitable locking mechanism is described in more detail in GB 2383202 to which reference is hereby directed and incorporated.

The release control 14 comprises a tab like formation 21 located in and exposed at a recess in a side surface 22 of the main body, adjacent a second end region 24 of the main body. The tab formation 21 operatively connects with the locking mechanism 20. A spring 25 of the locking mechanism normally biases the tab 21 of the release control 14 to reside in the position as shown in FIG. 4.

The handle 15 is of an open-sided, tubular form having a length substantially the same as that of the cable guide 12 which depends from the second end region 24 of the main body. The handle 15 is a plastics moulding which in this embodiment of the invention is formed integrally with the tab 21 of the release control 14. Alternatively the handle may be secured by other means relative to the tab 21.

Figure 3:
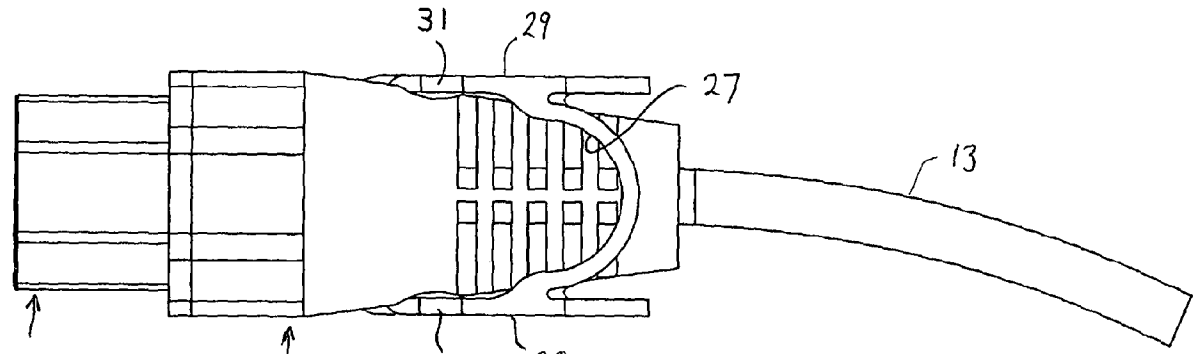
FIG. 3 is a view in the direction of arrow A of FIG. 1.
Figure 2:
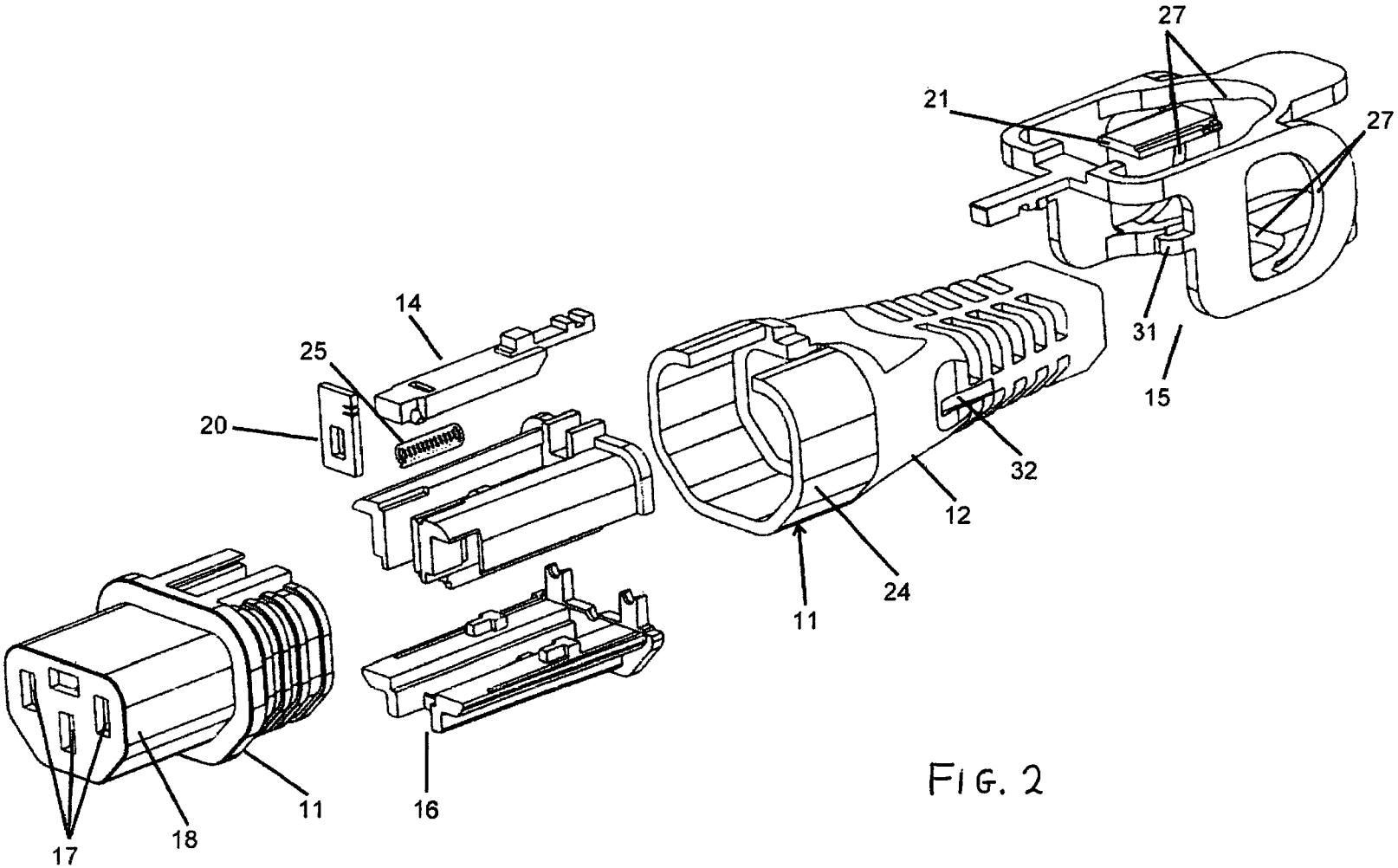
FIG. 2 is an exploded perspective view of the connector of FIG. 1.
Figure 5:
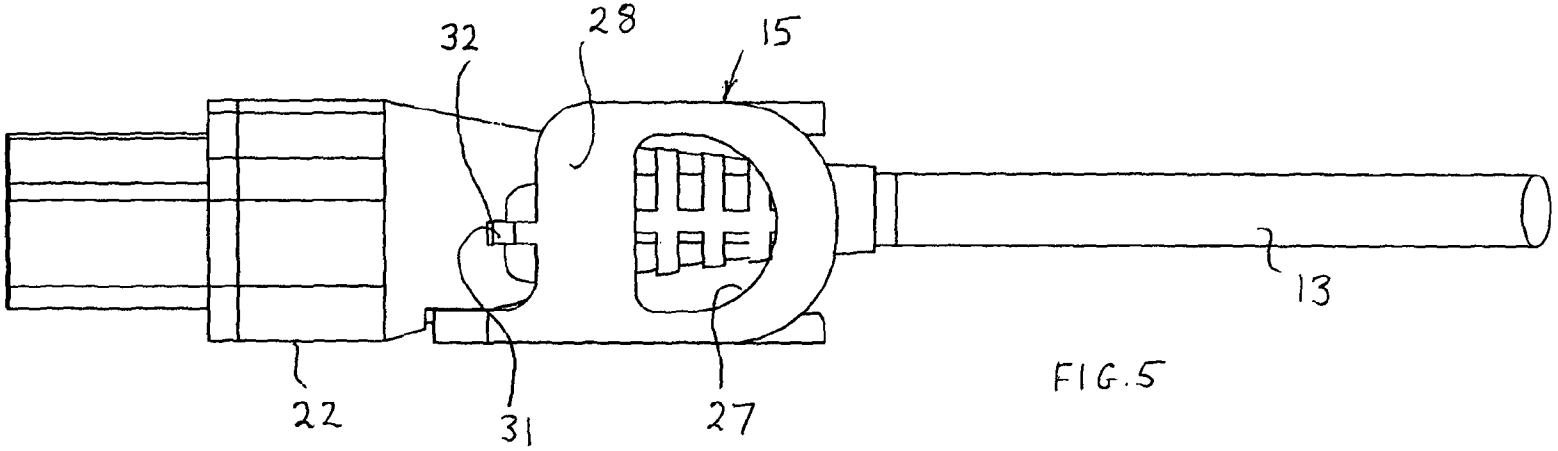
FIG. 5 is a view in the direction of arrow C of FIG. 1.
Figure 4:
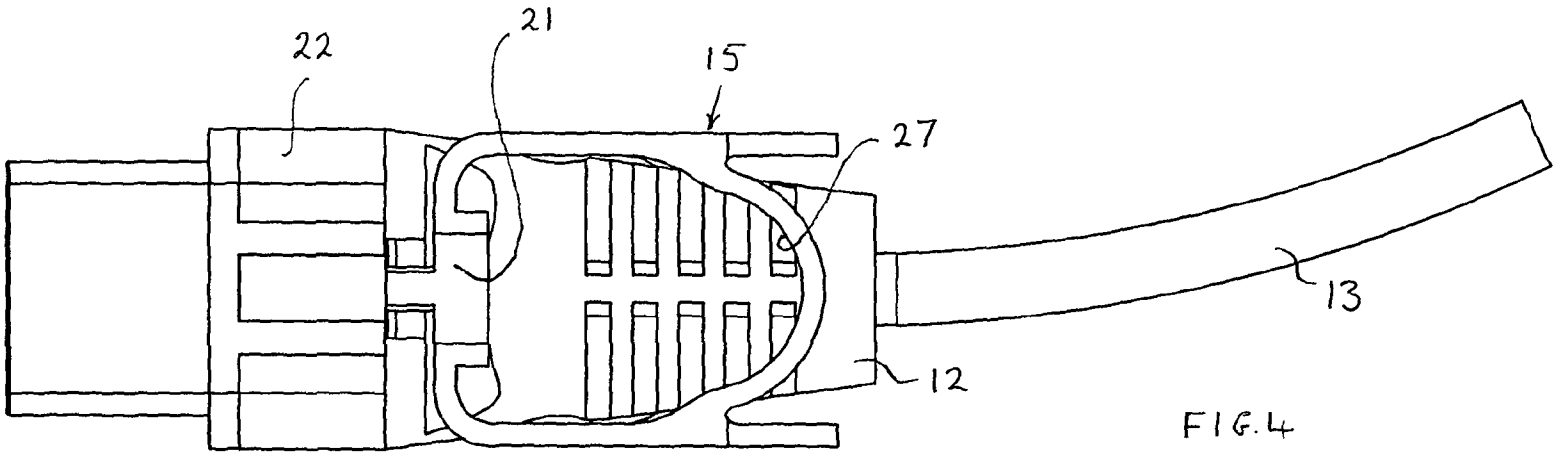
FIG. 4 is a view in the direction of arrow B of FIG. 1.

As considered in a cross-sectional plane perpendicular to the length of the elongate connector the handle has an outer cross-sectional profile substantially equal to the maximum cross-sectional outer profile of the main body as is evident from the views of FIGS. 3 to 5.

Each of the four side faces of the handle is apertured and provides a curved surface 27 against which a finger may readily apply force to move the handle away form the main body, in a direction parallel with the length of the connector.

In addition to being integral with the release control 14 the handle is provided at two side faces 28, 29 with two small lugs 30, 31 which engage with grooves 32 in the sides of the cable guide 12 thereby to assist in maintaining the handle aligned with the connector when the release control is in the locking position, and to assist with guiding the handle when moved in a direction away from said first end region 18.

Although the lugs 30 at one end of the handle contact the cable guide, the handle in general is spaced from the handle guide. The handle is of a substantially uniform wall thickness and thus, because of the tapered shape of the cable guide, the spacing between the handle and guide progressively increases in a direction towards the distal end of the cable guide. Thus the handle does not inhibit the ability of the guide to flex in the intended manner for minimising cable damage due to sharp changes of direction.

To release the locking mechanism it is necessary merely to engage with one or more of the curved handle surfaces 27 to pull the handle in a direction away from the main body. In consequence of that action the release control 14 is slid in a direction away from the first end region 18 of the connector, against the action of the bias spring 25, thereby to effect release of the locking mechanism 20. Continued application of force on the handle then effects separation of the connector from a complementary connector component to which the connector may have been connected.

Accordingly it will be understood that the present invention provides a connector which is suitable for use in connecting to equipment that restricts the space envelope around the main body of the connector, and that the ability for release of the locking mechanism is achieved without any requirement to increase the conventional longitudinal length of the connector.

The invention claimed is:

1. An electrical connector of elongate shape, which comprises:

a main body having a first end region which comprises one or more electrical contacts in use for contact with a complementary connector component and a second end region opposite said first end region and from which depends a protective guide through which, in use, a flexible conductor extends, said main body of the connector comprising a locking mechanism to enable the connector to be selectively releasably secured to a complementary connector component, and the connector comprising a release control operable to act on the locking mechanism and allow release of the connector from the complementary connector component, wherein said release control comprises a handle operable at a position further from the first end region of the connector than said second end as considered in the direction of the length of the connector, and the handle is supported relative to the protective guide by being connected to or formed integrally with the release control and, additional to said support provided by the release control, is supported by means of at least one formation which contacts the protective guide of the connector.

2. An electrical connector of elongate shape, which comprises:

a main body;

a first end region of the main body, which comprises one or more electrical contacts and a second end region of the main body opposite said first end region and from which depends a protective guide through which, in use, a flexible conductor extends;

a locking mechanism of the main body, said locking mechanism enabling the connector to be selectively releasably secured to a complementary connector component; and a release control operable to act on the locking mechanism and allow release of the connector from the complementary connector component, wherein said release control comprises a handle operable at a position further from the first end region of the connector than said second end as considered in the direction of the length of the connector, the handle is supported relative to the protective guide by being connected to or formed integrally with the release control and, additional to said support provided by the release control, is supported by means of at least one formation which contacts the protective guide of the connector, and said at least one formation serves, in use, to guide the handle to move in a direction substantially parallel with the length direction of the elongate connector.

3. An electrical connector of elongate shape, which comprises:

a main body;

a first end region of the main body, which comprises one or more electrical contacts and a second end region of the main body opposite said first end region and from which depends a protective guide through which, in use, a flexible conductor extends;

a locking mechanism of the main body, said locking mechanism enabling the connector to be selectively releasably secured to a complementary connector component; and a release control operable to act on the locking mechanism and allow release of the connector from the complementary connector component, wherein said release control comprises a handle operable at a position further from the first end region of the connector than said second end as considered in the direction of the length of the connector, the handle is supported relative to the protective guide by being connected to or formed integrally with the release control and, additional to said support provided by the release control, is supported by means of at least one formation which contacts either the main body or the protective guide of the connector, said at least one formation serves, in use, to guide the handle to move in a direction substantially parallel with the length direction of the elongate connector, and the main body or protective guide comprises two opposite side faces each formed with one of a groove or groove engaging projection which co-operates with a respective one of two groove or groove engaging formations of the handle thereby, in use, to assist in supporting and guiding movement of the handle.

4. The connector according to claim 3 wherein the release control is operable from a position aligned with said protective guide as considered in the length direction of the connector.

5. The connector according to claim 3 wherein the handle is integral with the release control.

6. The connector according to claim 3 wherein the release control is moveable in the length direction of the connector between a first, locking position and a second, release position.

7. The connector according to claim 3 and comprising bias means whereby the release control normally resides in a first, locking position but on application of force applied to the handle in a lengthwise direction of the connector, in a direction from the first to the second end region of the connector, effects movement of the release control to the second, release position.

8. The connector according to claim 3 wherein the handle is of a cross-sectional shape no larger than the maximum cross-sectional shape of the main body, as considered in the length direction of the connector.

9. The connector according to claim 3 wherein the handle is of an open, tubular shape which extends around the protective guide.

10. The connector according to claim 3 wherein the handle is of a skeleton like form.

11. The connector according to claim 3 wherein the protective guide is semi-flexible as compared with the rigidity of the main body.

12. The connector according to claim 3 wherein the handle is spaced from the protective guide whereby in use it does not inhibit flexibility of the guide.

13. The connector according to claim 3 wherein said at least one formation serves, in use, to guide the handle to move in a direction substantially parallel with the length direction of the elongate connector.

14. The connector according to claim 3 wherein the main body or protective guide comprises two opposite side faces each formed with one of a groove or groove engaging projection which co-operates with a respective one of two groove or groove engaging formations of the handle thereby, in use, to assist in supporting and guiding movement of the handle.

15. The connector according claim 3 wherein the locking mechanism is positioned within the main body of the connector and the release control connects to the locking mechanism from a position at the surface of the main body.

16. The connector according to claim 15 wherein the release control connects to the locking mechanism from a position at the surface of the main body which is close to the second end region of the main body.

17. The connector according to claim 3 wherein the handle comprises at least one finger grip position.

18. The connector according to claim 17 wherein the handle comprises two pairs of oppositely positioned finger grip positions.

19. The connector according to claim 3 wherein the handle comprises four side faces at least one of which is apertured or comprises a recess to provide a finger grip position.

20. The connector according to claim 19 wherein each of the four side faces is apertured or comprises a recess to provide a finger grip position.

* * * * *